US010106991B2

(12) United States Patent
Dombrowski et al.

(10) Patent No.: US 10,106,991 B2
(45) Date of Patent: Oct. 23, 2018

(54) PAVER PEDESTAL AND METHOD OF INSTALLING SAME

(71) Applicant: Wausau Tile, Inc., Wausau, WI (US)

(72) Inventors: Rodney Dombrowski, Schofield, WI (US); Rene Dupuis, Middleton, WI (US)

(73) Assignee: Wausau Tile, Inc., Wausau, WI (US)

( * ) Notice: Subject to any disclaimer, the term of this patent is extended or adjusted under 35 U.S.C. 154(b) by 0 days.

(21) Appl. No.: 15/169,140

(22) Filed: May 31, 2016

(65) Prior Publication Data

US 2016/0348831 A1 Dec. 1, 2016

Related U.S. Application Data

(60) Provisional application No. 62/169,468, filed on Jun. 1, 2015.

(51) Int. Cl.
*E04F 15/024* (2006.01)
*E04D 11/00* (2006.01)

(52) U.S. Cl.
CPC ..... *E04F 15/02464* (2013.01); *E04D 11/007* (2013.01); *E04F 15/0247* (2013.01); *E04F 15/02482* (2013.01)

(58) Field of Classification Search
CPC ..... E04F 15/0247; E04F 15/02464; E04D 11/007
See application file for complete search history.

(56) References Cited

U.S. PATENT DOCUMENTS 1,818,633 A * 8/1931 Levin ..... E21D 15/12 248/351
4,546,580 A * 10/1985 Ueno ..... E04D 11/005 52/126.1
4,578,910 A * 4/1986 Germeroth ..... E04F 15/02452 24/590.1
4,996,804 A * 3/1991 Naka ..... E04F 15/02452 52/126.1

(Continued)

FOREIGN PATENT DOCUMENTS

CA 2810079 A1 9/2013
CA 2775453 A1 7/2014

*Primary Examiner* — Andrew J Triggs
(74) *Attorney, Agent, or Firm* — Michael Best & Friedrich LLP

(57) ABSTRACT

Pedestals for supporting pavers on a roof or other surface are provided. In some cases the pedestal has a cylindrical core, a base coupled to the cylindrical core and positioned to support the cylindrical core, and a support plate coupled to the cylindrical core and adapted to support at least one paver. In some cases, the pedestal includes an anchoring assembly having a collar positioned axially between the base and the support plate, and an arm extending radially outward from the collar and having a distal end adapted to be mounted to the roof or other surface at a location spaced apart from the cylindrical core. Also, in some cases a mounting member is provided that extends to and between a first location proximate the cylindrical core and a second location on the roof or other surface distal from the cylindrical core and the base. In some cases, top and bottom pads are used to receive a paver therebetween, wherein the top and/or bottom pads are adapted to rotate relative to the cylindrical core.

18 Claims, 9 Drawing Sheets

(56) References Cited

U.S. PATENT DOCUMENTS 5,333,423 A * 8/1994 Proust ..... E04F 15/02476 248/188
5,588,264 A 12/1996 Buzon
6,256,939 B1 7/2001 Snyder
6,349,513 B1 * 2/2002 Chen ..... E04F 15/0247 52/126.5
6,363,685 B1 * 4/2002 Kugler ..... E04F 15/02183 52/126.6
6,520,471 B2 2/2003 Jones et al.
6,983,570 B2 * 1/2006 Mead ..... E04F 15/02452 248/188.2
7,866,096 B2 1/2011 Lee et al.
7,918,059 B2 * 4/2011 Repasky ..... E04D 11/007 52/126.4
7,921,612 B2 4/2011 Knight, III et al.
8,156,694 B2 4/2012 Knight, III et al.
8,181,399 B2 * 5/2012 Knight, III ..... E04D 11/007 52/126.1
8,256,175 B2 9/2012 Buzon
8,302,356 B2 * 11/2012 Knight, III ..... E04D 11/007 52/126.7
8,365,475 B2 2/2013 Zlatar
8,381,461 B2 2/2013 Repasky
8,387,317 B2 3/2013 Kugler et al.
8,898,999 B1 * 12/2014 Kugler ..... E04F 15/02464 52/126.6
2003/0070372 A1 4/2003 Favero
2004/0261329 A1 * 12/2004 Kugler ..... E04F 15/02183 52/126.6
2010/0000163 A1 * 1/2010 Tsai ..... E04F 15/02405 52/126.6
2011/0138703 A1 * 6/2011 Repasky ..... E04D 11/007 52/126.6
2014/0083047 A1 3/2014 Kugler et al.
2014/0237912 A1 8/2014 Kugler et al.
2016/0040439 A1 * 2/2016 Pelc ..... E04F 15/02452 52/126.6
2016/0348831 A1 * 12/2016 Dombrowski ..... F16M 11/18

* cited by examiner

PAVER PEDESTAL AND METHOD OF INSTALLING SAME

CROSS-REFERENCE TO RELATED APPLICATIONS

Priority is hereby claimed to U.S. Provisional Patent Application No. 62/169,468 filed on Jun. 1, 2015, the entire contents of which are incorporated herein by reference.

BACKGROUND

The present invention relates to pedestals, and particularly to pedestals for use with pavers on a roof or other surface.

SUMMARY

In some embodiments, a pedestal for supporting pavers on a surface is provided, and comprises a cylindrical core; a base coupled to the cylindrical core and positioned to support the cylindrical core on the surface; a support plate coupled to the cylindrical core and adapted to support at least one paver; and an anchoring assembly including a collar positioned axially between the base and the support plate; and an arm extending radially outward from the collar, the arm having a distal end adapted to be mounted to the surface at a location spaced apart from the cylindrical core.

Some embodiments of the present invention provide a pedestal for supporting pavers on a surface, wherein the pedestal comprises a cylindrical core having a first end and a second end; a base coupled to the cylindrical core proximate the first end, the base positioned to support the cylindrical core; a support plate coupled to the cylindrical core proximate the second end, the support plate adapted to support at least one paver tile; and a mounting member extending to and between a first location proximate the cylindrical core and a second location on the surface distal from the cylindrical core and the base.

In some embodiments, a pedestal for supporting pavers on a surface is provided, and comprises a cylindrical core having a first end and a second end; a base coupled to the cylindrical core proximate the first end; a support plate coupled to the pedestal proximate the second end, the support plate adapted to support at least one paver; and a top pad and a bottom pad adapted to receive the paver between the top pad and the bottom pad, the bottom pad coupled to and supported by the support plate, wherein at least one of a group consisting of the bottom pad and the top pad is adapted to rotate relative to the cylindrical core.

Other aspects of the invention will become apparent by consideration of the detailed description and accompanying drawings.

DETAILED DESCRIPTION

Before embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways.

FIGS. 1-8 illustrate a pedestal 10 for use with tiles or pavers (referred to herein simply as "pavers") on a roof or other surface. Generally, the pedestal 10 is utilized to elevate and support pavers above a roof or other surface. As used herein and in the appended claims, the term "paver" includes any platform, slab, tile, plate, or other similar element that is typically flat and/or planar, and that can be assembled in patterned (e.g., rows, grids, and the like) or patternless groups to define an extended surface over a roof or other surface, regardless of whether the extended surface is intended to support human or animal traffic, and regardless of whether the extended surface is capable of supporting a load (other than that defined by the pavers and pedestals). Pavers are not limited to any particular materials, and can be composed of concrete, plastic, granite and other stone, wood, ceramic, glass, metal, terrazzo, asphalt, and any combination of such materials, by way of example only. The pedestal 10 can also be installed on surfaces other than roofs where it is desirable to elevate the pavers with respect to an underlying structure or substrate. For example, the pedestal 10 can be used to support patios, terraces, parking garage surfaces, or plazas. The illustrated pedestal 10 is particularly well suited to elevate pavers located in places experiencing high winds and/or seismic conditions. As will be described in further detail below, some embodiments of the illustrated pedestal 10 are resistant to high-wind and/or seismic conditions.

Figure 1:
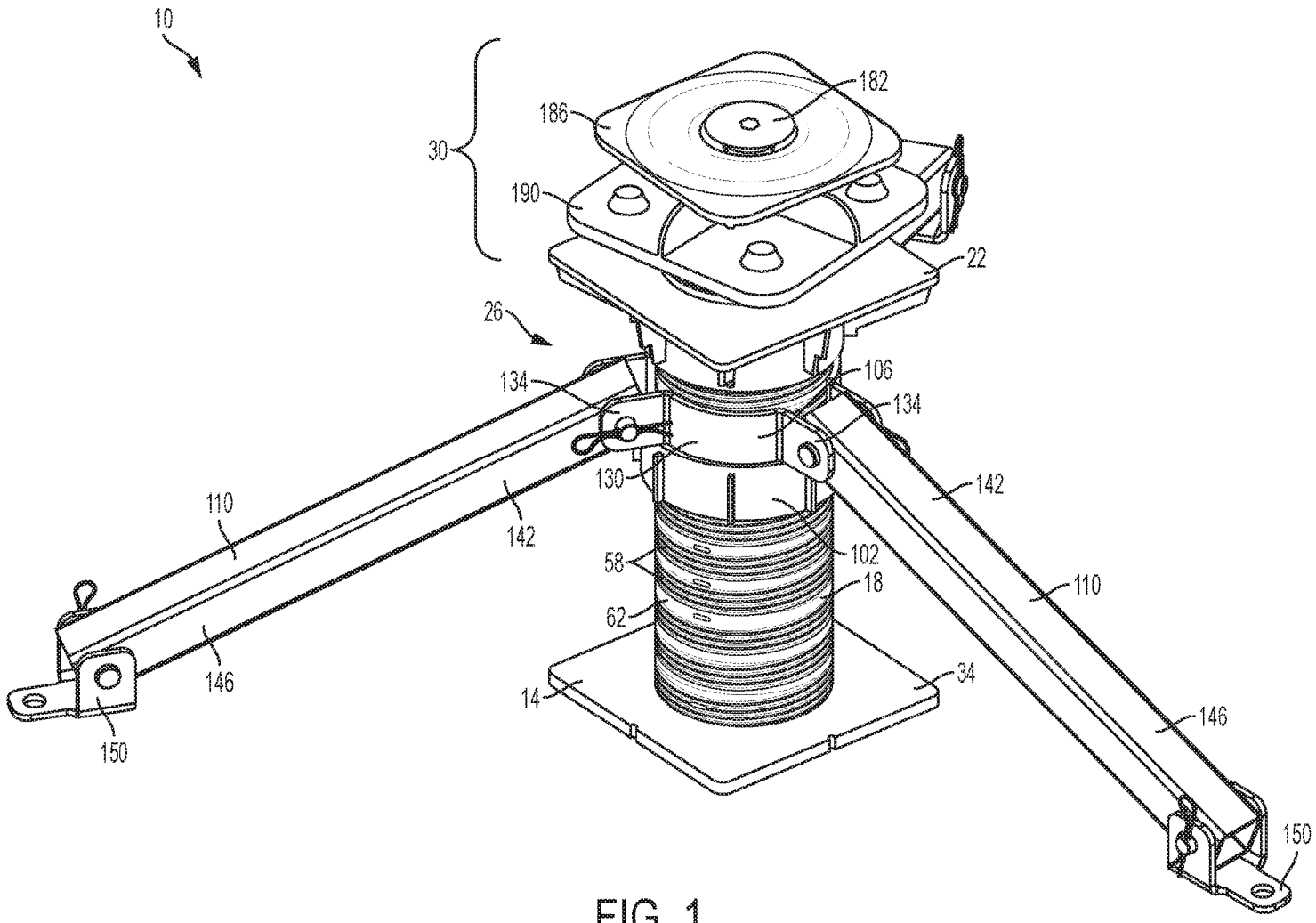
FIG. 1 is a perspective view of a pedestal according to an embodiment of the present invention, shown with an anchoring assembly.
Figure 2:
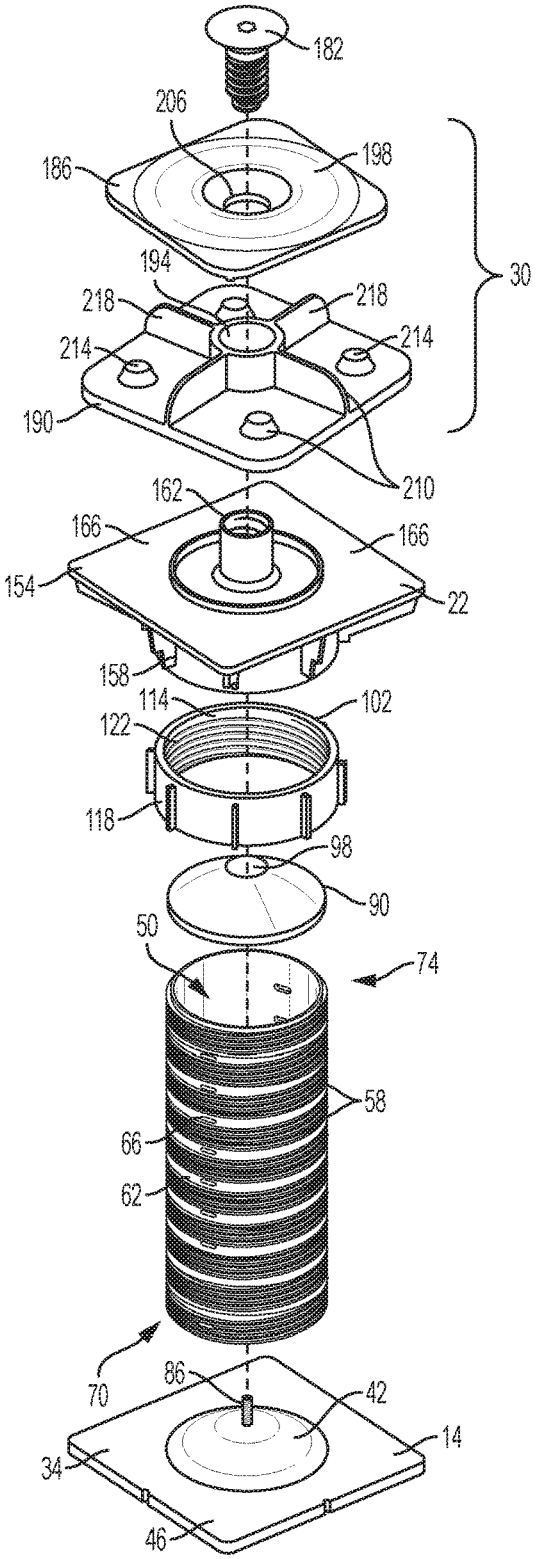
FIG. 2 is an exploded top perspective view of the pedestal of FIG. 1.

With reference to FIG. 1, a pedestal 10 according to an embodiment of the present invention includes a base 14, a core 18, and a support plate 22. In addition, the illustrated pedestal 10 is supported by an anchoring assembly 26, and further includes a lockdown assembly 30. The components of the pedestal 10 are not limited to any particular materials, and can be composed of concrete, plastic, granite and other stone, wood, ceramic, glass, metal, terrazzo, asphalt, and any combination of such materials, by way of example only. The base 14 includes a top surface 34 and a bottom surface 38. The base 14 is positioned so that the bottom surface 38 is in contact with a roof or other surface upon which the pedestal is installed. The illustrated bottom surface 38 (FIG. 3) is generally flat, but can include a texture and/or shape that increases friction of the base 14 against the roof or other surface. The top surface 34 of the illustrated base 14 is generally parallel to the bottom surface 38, but in other embodiments can take any other shape desired. As illustrated in FIG. 2, the top surface 34 defines a convex surface 42 and a flat portion 46 extending beyond the convex portion. The top surface of the base 14 supports the core 18.

In the illustrated embodiment of FIGS. 1-4, the core 18 defines a cylindrical body having a hollow cavity 50 and a center axis 54 (see FIG. 9) extending through the hollow cavity 50. The size and shape of the core can vary to accommodate different height and/or load bearing circumstances. External threads 58 extend along at least a portion of the core 18. The threads 58 in the illustrated embodiment are subdivided such that there are spaces 62 interspersed between sets of threads 58. The spaces 62 enable a cutting blade to fit between threads 58 so the core 18 can be cut to different heights. In addition, the spaces 62 can be provided with drain outlets 66 to allow rain water and other moisture to escape from inside the hollow cavity 50, as shown by way of example in the illustrated embodiment. In other embodiments, the core 18 includes internal threads in addition to, or in place of, the external threads 58. The threads 58 can extend across the entire length of the core 18 or can extend across only a portion of the core 18.

Figure 3:
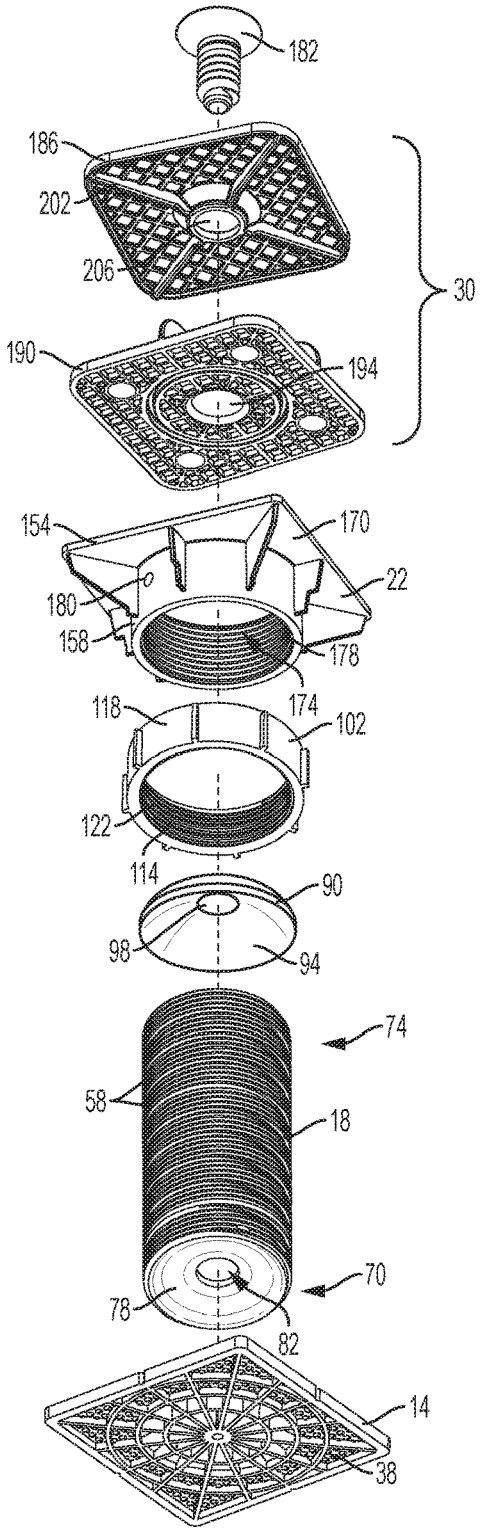
FIG. 3 is an exploded bottom perspective view of the pedestal of FIGS. 1 and 2.

With continued reference to the illustrated embodiment of FIGS. 1-4, the core 18 further includes a first end 70 that engages with the base 14 and a second end 74 that engages with the support plate 22. As best shown in FIG. 3, the first end 70 is at least partially closed by a concave surface 78 having an aperture 82. When the core 18 is positioned on the base 14, the concave surface 78 of the core 18 engages with the convex surface 42 of the base 14. Specifically, the core 18 can be positioned on the base 14 such that the center axis 54 of the core 18 is oriented in a generally vertical direction. The interface of the concave surface 78 and convex surface 42 has relatively low friction to enable the core 18 to be adjusted on the base 14. In other words, when the core 18 is placed on the base 14, the core 18 can swivel and/or rotate in order to maintain the vertical orientation of the axis 54. This is particularly useful when positioning the pedestal 10 on uneven surfaces or a pitched surface.

Figure 9:
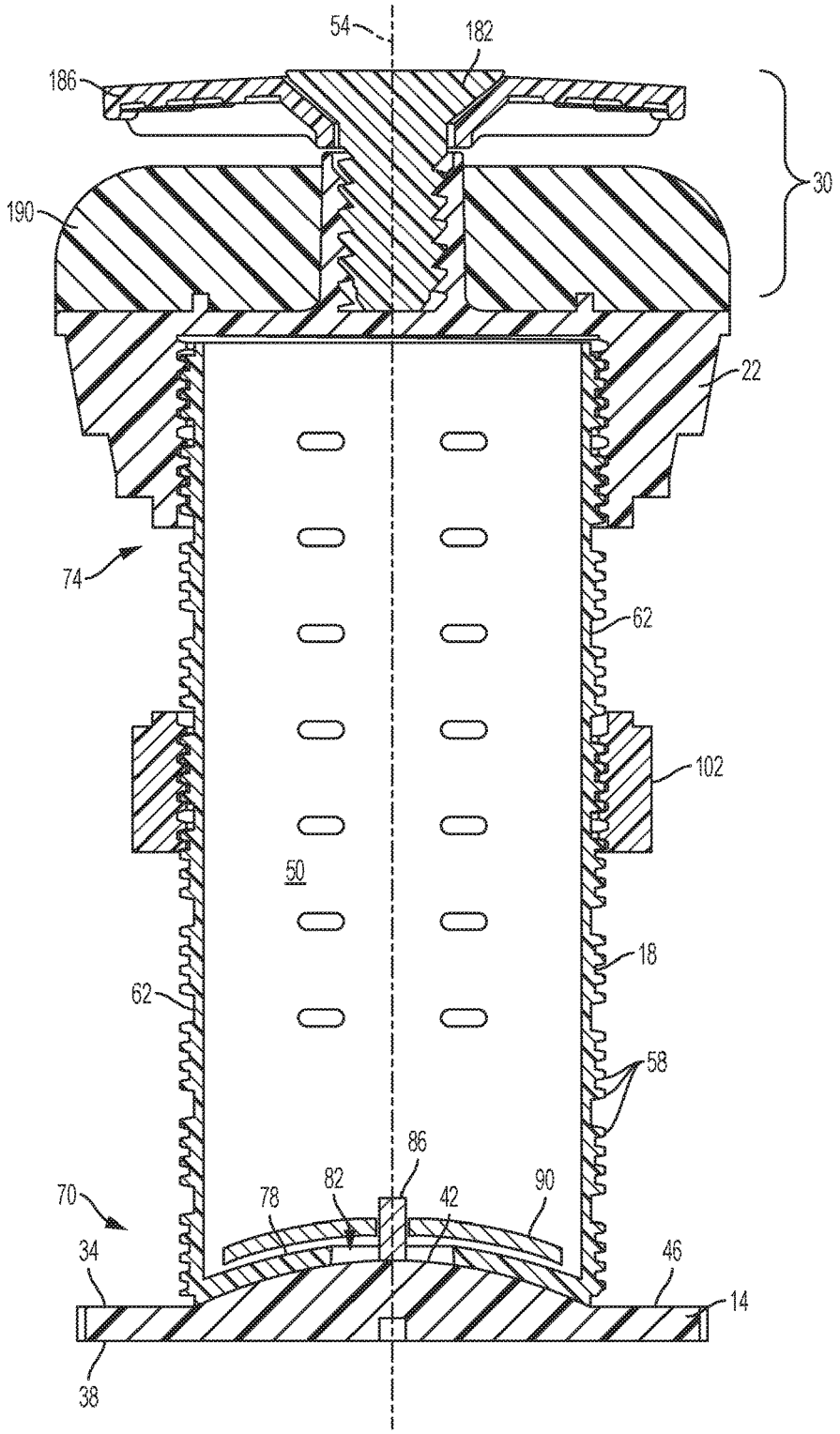
FIG. 9 is an assembled cross-sectional view of the lockdown assembly of FIG. 8.

In the illustrated embodiment, and with particular reference to FIGS. 2 and 9, the core 18 is coupled to the base 14 by a threaded fastener 86 that extends vertically from the base 14, through the aperture 82, and through an aperture 98 in a cap 90. The cap 90 can be positioned inside the hollow cavity 50 towards the first end 70 of the core 18, and can have a concave surface 94 that matches the concave surface 78 of the core 18. A nut (not shown) is screwed onto the threaded fastener 86 to secure the base 14, the core 18, and the cap 90 in one of several possible positions with respect to one another. The aperture 82 of the core 18 has a large enough diameter to permit movement of the core 18 with respect to the base 14 without interference from the threaded fastener 86. Other types of fasteners and/or mounting devices known in the art can be used to couple the core 18 to the base 14 in a range of possible positions or in any of two or more positions. For example, a snap-on fastener or ball and socket fastener can be used in place of the threaded fastener 86. In other embodiments, the core 18 can be threadably coupled directly to the base 14. For example, the base 14 can include a cylindrical extension having internal or external threads coupled to external or internal threads of the core 18, respectively. In still other embodiments, the core 18 and base 14 can be integral with one another or can be attached to one another without the ability to adjust the position of the core 18 with respect to the base 14 (i.e., to vary and secure the vertical orientation of the core 18 upon the base 14) as described herein.

Figure 4:
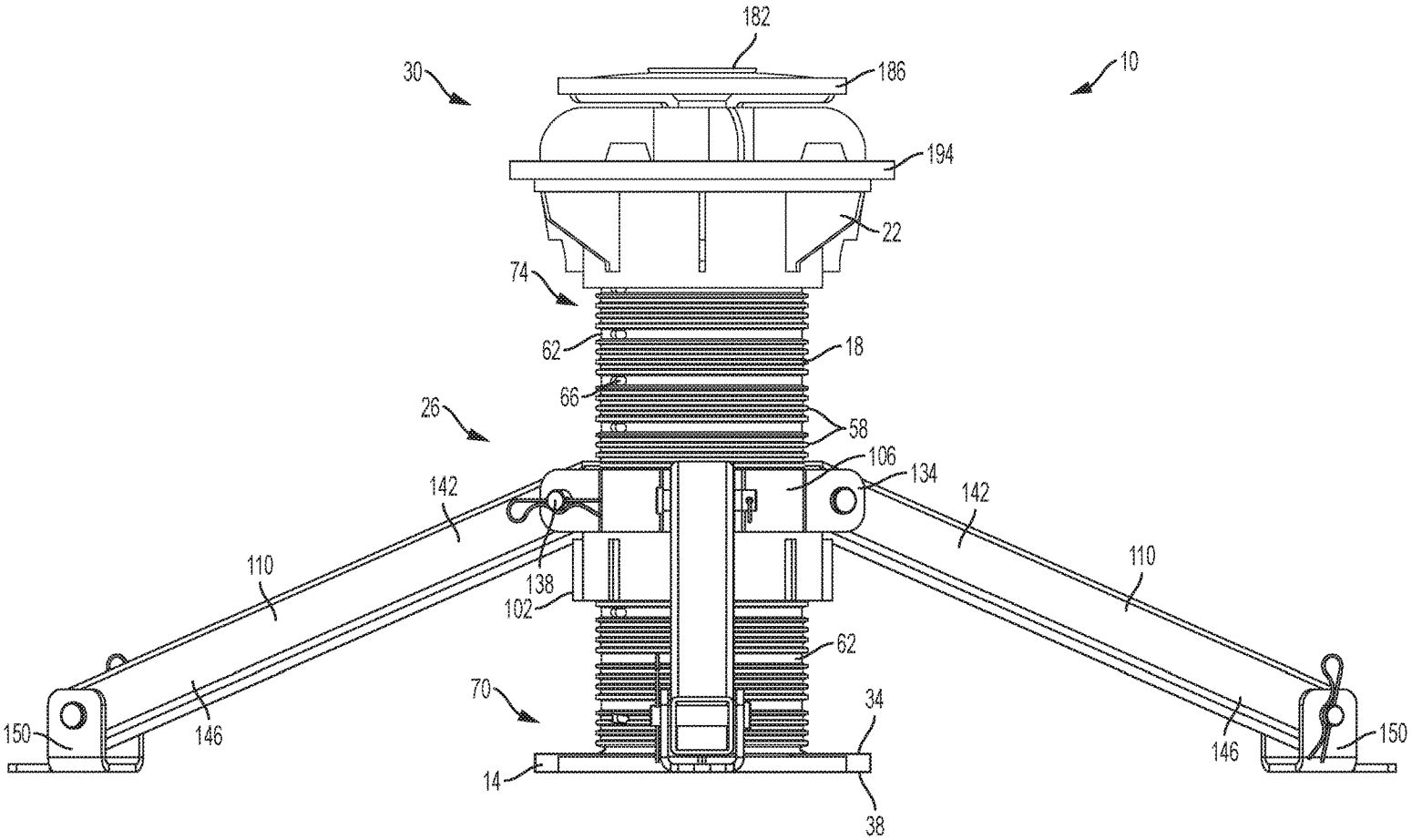
FIG. 4 is an elevational view of the pedestal of FIG. 1, shown with an anchoring assembly installed.
Figure 5:
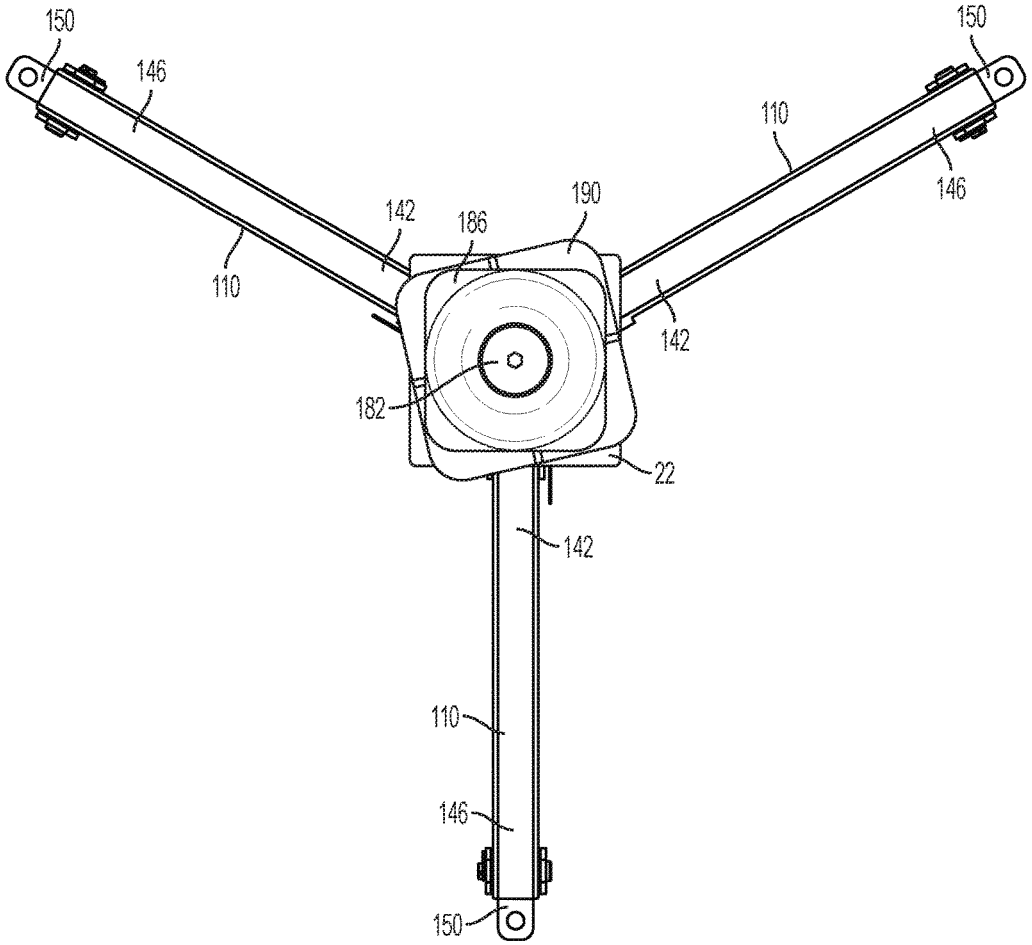
FIG. 5 is a top view of the pedestal of FIG. 4.
Figure 6:
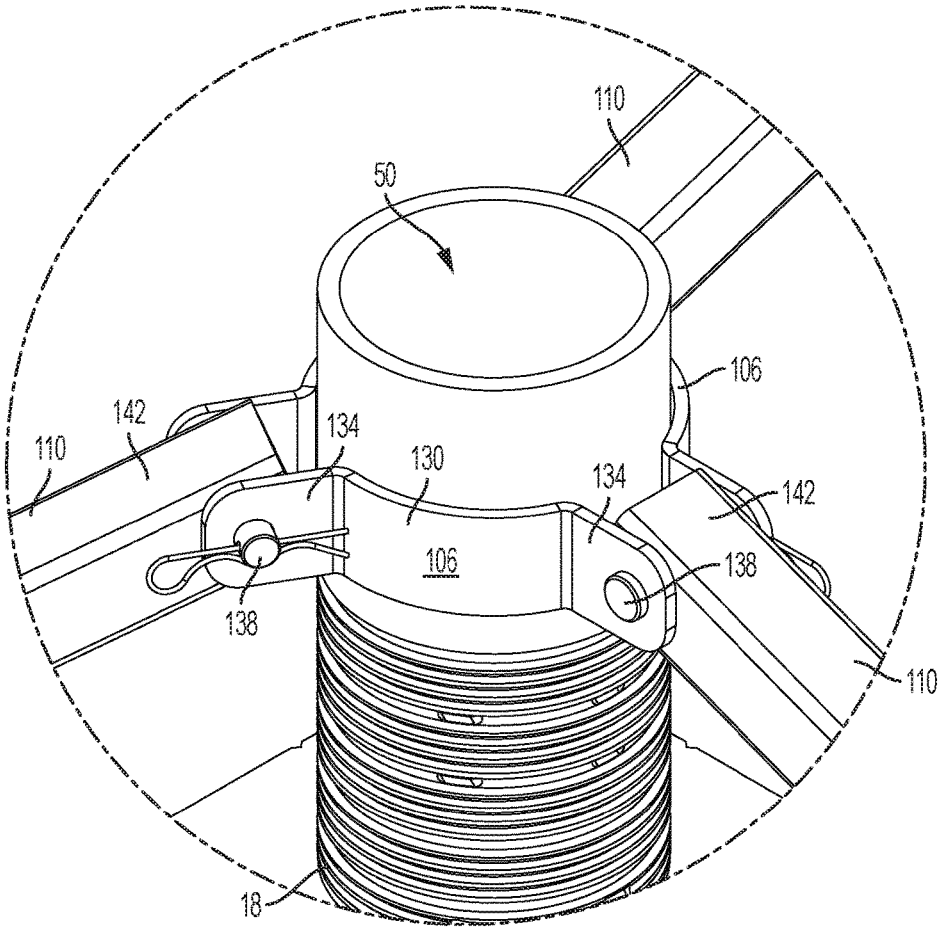
FIG. 6 is a top detail perspective view of the pedestal of FIGS. 4 and 5.

With reference to FIGS. 1 and 4, the core 18 of the illustrated embodiment is also supported in a vertical position on the base 14 by the anchoring assembly 26. The illustrated anchoring assembly 26 includes a support ring 102, a collar 106, and at least one mounting member (each shown in FIGS. 1 and 4-7 as arms 110), which can take any shape and form extending to and between the collar 106 or a location proximate the core 18, and another distal location on the roof or other surface in order to transfer forces therebetween. The illustrated support ring 102 is positioned around the core 18 between the first end 70 and second end 74 of the core 18. As illustrated in FIGS. 2-3, the support ring 102 includes an inside surface 114 and an outside surface 118. The inside surface 114 is internally threaded. The internal threads 122 of the support ring 102 engage with the external threads 58 of the core 18. Tabs 126 protrude from the outside surface 118 of the support ring 102 to assist in threading the support ring 102 onto the core 18. The support ring 102 can be moved to different positions between the first end 70 and second end 74 of the core 18. Also, the illustrated support ring 102 is adapted to support the collar 106, and can therefore support the collar 106 at different heights along the core 18.

With continued reference to FIGS. 1 and 4, the collar 106 surrounds the core 18 and rests on the support ring 102 in a position between the support ring 102 and the second end 74 of the core 18. The collar 106 can encircle the entire circumference of the core 18, or can encircle only a portion of the core 18. For example, the collar 106 can be U-shaped so that it can be laterally "snapped" onto the core 18 rather than completely encircling the core 18. The illustrated collar 106 shown in FIG. 6 includes three arcuate portions 130 that each partially encircle the core 18 and that together cooperate to encircle the core 18. The arcuate portions 130 are coupled between the one or more arms 110 of the anchoring assembly 26. Greater or fewer arcuate portions 130 can be utilized depending at least in part upon the number of arms 110. Each arcuate portion 130 of the illustrated collar 106 includes two flanges 134 positioned on opposite ends of the arcuate portion 130. Each pair of adjacent flanges 134 is coupled to an arm 110 by a fastener 138. In the illustrated embodiment, the fastener 138 is a hinge pin extending through the arm 110 and flanges 134. Other types of fasteners 138 can be used in place of the hinge pin. For example, a shoulder bolt can be used to couple the arms 110 to the arcuate portion 130. A shoulder bolt can assist in tightening the collar 106 to the core 18. In some embodiments, the collar 106 encircles the entire circumference of the core 18, and one or more arms 110 are coupled to and extend radially from the collar 106. Also, in some embodiments, the collar 106 includes internal threads, and is self-supporting along the core 18 by being threaded onto the external threads 58 of the core 18. In such embodiments, the support ring 102 may be excluded. The collar 106 is adapted to support the one or more arms 110 in positions that enable the arms 110 to mount the pedestal 10 to the surface.

FIGS. 1 and 4 illustrate the arms 110 extending radially outward from the collar 106. The arms 110 each have a proximal end 142 coupled to the collar 106 and a distal end 146 coupled (or mounted) to the surface at a position spaced apart from the core 18 and the base 14. The proximal ends 142 of the arms 110 are pivotably coupled to the collar 106 in the illustrated embodiment, although non-pivotal connections and/or integral connections between the arms 110 and the collar 106 are possible. When the collar 106 is positioned proximate the second end 74 of the core 18 (see FIG. 1), the angle formed between the axis 54 of the core 18 and the arms 110 is less than the angle formed between the axis 54 of the core 18 and the arms 110 when the collar 106 is positioned closer to the first end 70 of the core 18 (see FIG. 4).

Figure 7:
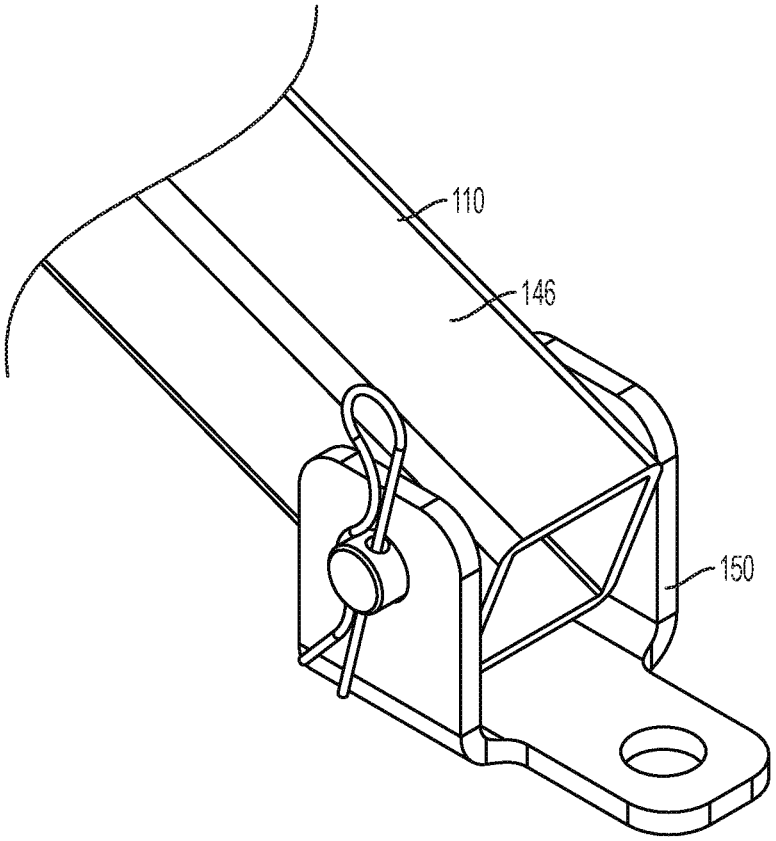
FIG. 7 is detailed perspective view of the anchoring assembly in FIGS. 4-6.

Additionally, as illustrated in FIG. 7, each of the illustrated arms 110 includes a foot 150 coupled to the distal end 146 of the arm 110. The foot 150 can be adapted to be mounted to the surface by a fastener (not shown). Each foot 150 can be pivotably coupled to the arm 110 to allow the foot 150 to rotate with respect to the arm 110. This enables the foot 150 to maintain a generally flush contact with the surface regardless of the angle of the arm 110 with respect to the surface. However, in other embodiments, the feet 150 (if used) are not pivotably or adjustably attached to the arms 110.

The anchoring assembly 26 is adapted to support the core 18 in a vertical direction and to withstand seismic and/or high-wind conditions. When high winds or seismic forces are present, the arms 110 can transfer forces more effectively to locations distal from the core 18 and/or base 14, thereby helping to prevent the pedestal 10 from being tipped, detached from the surface, damaged, or otherwise failing in support of the pavers. Typical pedestals 10 are either not mounted directly to the surface, or include only a single mounting location at the center of the pedestal 10. However, the illustrated embodiment of FIGS. 1 and 4-7 includes the anchoring assembly 26, which increases the ability of the pedestal 10 to withstand high winds and seismic events by providing multiple mounting locations. Because the arms 110 are mounted at distal locations spaced apart from the core 18 and base 14, the arms 110 can work together to resist forces from high winds and seismic events. For example, when a high wind exerts a force on the pedestal 10, a first arm 110 may oppose the force from "pulling" the pedestal 10 out of position, and a second arm 110 may oppose the force from "pushing" the pedestal 10 out of position. Other arms 110 may oppose the force from tipping the pedestal 10 in a sideways direction. Rather than a single mounting location bearing the burden of opposing the entire force, the arms 110 share the burden of opposing the force, thus reducing the amount of force a single mounting location must bear.

While the anchoring assembly 26 supports the pedestal 10 on the surface, the support plate 22 and the lockdown assembly 30 support the pavers on the pedestal 10. With continued reference to the illustrated embodiment, the second end 74 of the core 18 engages with the support plate 22. The support plate 22 is adapted to support one or more pavers in an elevated position above the base 14. The illustrated support plate 22 shown in FIGS. 1-5, 8 and 9 includes a platform 154, a cylindrical portion 158, and a hub 162. The platform 154 includes a top surface 166 and a bottom surface 170. The cylindrical portion 158 extends vertically downward from the bottom surface 170 of the platform 154, and includes an opening 174 (see FIG. 3) for receiving the second end 74 of the core 18. The opening 174 is internally threaded such that the internal threads 178 of the cylindrical portion 158 engage with the external threads 58 of the core 18. Alternatively, the cylindrical portion 158 can be externally threaded and the core 18 internally threaded such that the cylindrical portion 158 is received within the hollow cavity 50 of the core 18.

These threaded configurations enable the support plate 22 to be threaded to a deeper or shallower extent with respect to the core 18, which adjusts the overall height of the pedestal 10. Threading the support plate 22 deeper onto the core 18 reduces the height of the pedestal 10, while threading the support plate 22 to a shallower extent increases the height of the pedestal 10. In some embodiments by way of example only, the support plate 22 enables the pedestal 10 height to be adjusted approximately 1-4 inches. Additionally, a site gauge 180 (FIG. 3) is positioned on the cylindrical portion 158 of the support plate 22. The site gauge 180 serves as a visual means of ensuring the support plate 22 is minimally engaged with the core 18.

The hub 162 of the illustrated support plate 22 extends vertically upward from the top surface 166 of the platform 154. The illustrated hub 162 includes internal threads (not shown) for receiving a threaded fastener, for example, a bolt 182. In the illustrated pedestal 10, the cylindrical portion 158 and the hub 162 are generally aligned with the axis 54 of the core 18. The support plate 22 can be any shape or size suitable for supporting the paver(s) above the base 14. For example, the platform 154 can be circular, triangular, diamond, oval, or irregularly shaped. In other embodiments, the support plate 22 can be cubic with an opening recessed internally from a bottom side to engage the core 18 and a hub recessed internally from a top side. The support plate 22 can support the paver(s) at an elevated position above the base 14 with the assistance of the lockdown assembly 30.

Figure 8:
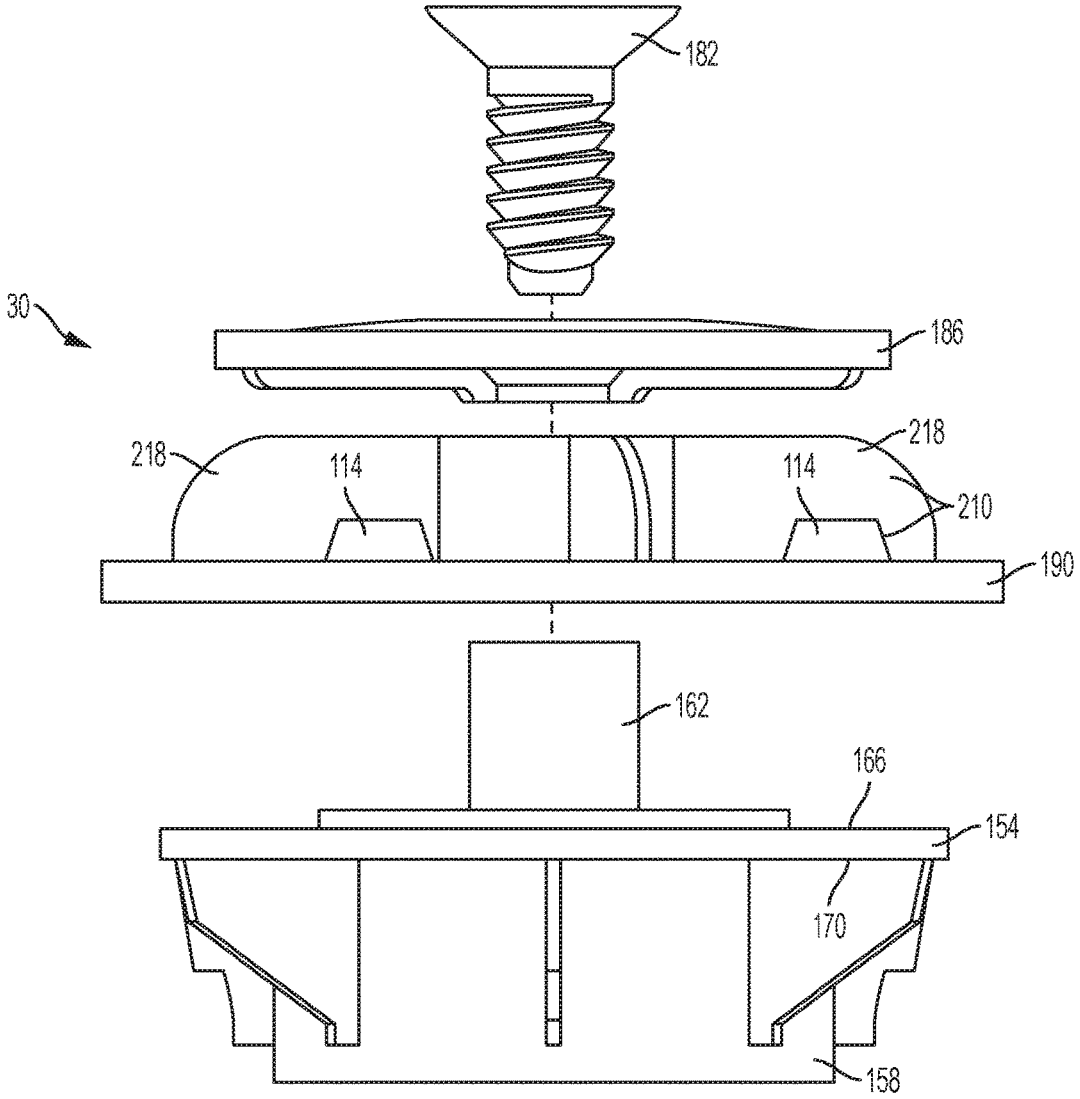
FIG. 8 is an exploded view of a lockdown assembly used in the pedestals of FIGS. 1-8.

The lockdown assembly 30 shown in FIG. 8 is coupled to the top surface 166 of the support plate 22. The illustrated lockdown assembly 30 includes a top pad 186 and a bottom pad 190. The bottom pad 190 is provided with an orifice 194 (see FIGS. 2 and 3) that is adapted to receive the hub 162 of the support plate 22. When the bottom pad 190 is placed on top of the support plate 22, the hub 162 fits within the orifice 194 and extends through the bottom pad 190 to secure the bottom pad 190 to the support plate 22. This configuration allows the bottom pad 190 to rotate with respect to the support plate 22. The illustrated top pad 186 includes a top surface 198, a bottom surface 202, and an aperture 206. When the top pad 186 is placed on top of the bottom pad 190, the aperture 206 of the top pad 186 aligns generally with the orifice 194 of the bottom pad 190 and the hub 162 of the support plate 22. This alignment allows the bolt 182 to pass through the aperture 206 of the top pad 186 and thread into the hub 162. The bolt 182 secures the top pad 186, the bottom pad 190, and the support plate 22 together. However, in some embodiments the top pad 186, the bottom pad 190, and the support plate 22 can still each rotate relative to one another. Rotation of the lockdown assembly 30 with respect to the support plate 22 provides flexibility and ease of paver installation.

One or more pavers is received between the top pad 186 and bottom pad 190 of the lockdown assembly 30. In some embodiments, for example, four pavers are received between the top pad 186 and the bottom pad 190 such that only one corner of each of the four pavers is positioned between the top pad 186 and the bottom pad 190. The pavers are supported by the bottom pad 190 and are secured (or locked down) by the top pad 186. Other methods of positioning pavers in the lockdown assembly are possible. For example, rather than positioning the corners of four pavers between the top pad 186 and the bottom pad 190, the sides (or edges) of two pavers can be positioned between the top pad 186 and the bottom pad 190.

With continued reference to the illustrated embodiment, and to FIG. 8 in particular, one or both of the top pad 186 and the bottom pad 190 can include one or more projections 210. The projections 210 can help align the paver(s) between the top pad 186 and the bottom pad 190 and can reduce movement of the paver. In the illustrated embodiment of FIG. 8, two types of projections 210 are shown. The first type of projection 210 is a raised projection 114. The raised projection 114 protrudes from the bottom pad 190 to engage a corresponding recess (not shown) in the paver. The raised projections 114 prevent the paver from slipping out from between the bottom pad 190 and the top pad 186. The second type of projection 210 illustrated is a divider projection 218. The divider projections 218 space apart the corners of the pavers and help keep the pavers in relatively straight alignment with respect to one another. Other forms of projections 210 can be used to align the pavers and to keep them in desired positions between the top and bottom pads 186, 190. Recesses can also be used in place of, or in addition to, the projections 114, 210. The recesses can be adapted to receive projections on the pavers. In some embodiments, no projections or recesses are used to align or retain the pavers as described above.

In operation, the pedestal 10 is assembled by first determining the desired height of the pedestal 10. It is not necessary to determine the exact height, since the pedestal 10 can be adjusted by threading the support plate 22 deeper or shallower onto the core 18. The core 18 can be shortened to the desired height by cutting the core 18 at a space between threads 58. Once the core 18 is cut to the desired height, the pedestal 10 can be installed on the surface. The base 14 can be placed on the surface with the threaded fastener 86 facing upward. When multiple pedestals 10 are being assembled, the bases 14 can be spaced apart a distance approximately the length of the paver to be supported. The core 18 is then placed on top of the base 14 so that the concave surface 78 of the core 18 is in contact with the convex surface 42 of the base 14, and the threaded fastener 86 passes through the aperture 82 of the core 18 into the hollow cavity 50. The cap 90 is inserted into the hollow cavity 50 towards the first end 70 of the core 18, and is positioned to so that the concave surface 94 of the cap 90 is flush with the concave surface 78 of the core 18. When aligned properly, the threaded fastener 86 should extend through the hole 98 of the cap 90, with a portion of the threaded fastener 86 exposed above the cap 90. At this point, the core 18 can be adjusted on the convex portion 42 of the base 14 to ensure that the core 18 is aligned vertically. A nut is screwed onto the exposed portion of the threaded fastener 86 to secure the base 14, the core 18, and the cap 90 in fixed position and orientation together.

Next, the anchoring assembly 26 (if used) is assembled on the core 18. In the illustrated embodiment, the support ring 102 is threaded onto the core 18 to a desired position along the core 18. In a preferred embodiment, the collar 106 and arms 110 are assembled separately prior to being positioned on the pedestal 10. The arms 110 are coupled to the collar 106 in various manners depending on the style of collar 106 used. The collar 106 and arms 110 are then lowered onto the core 18 until the collar 106 rests on the support ring 102. The support ring 102 can be re-adjusted to different heights along the core 18 to change the angle of the arms 110. Once the arms 110 are in position, the feet 150 can be mounted to the surface. In some applications, the anchoring assembly 26 is not needed, so is not installed on the core 18.

In some embodiments, concrete can be poured into the hollow cavity 50 of the core 18 for additional strength. A plastic sleeve may be inserted into the core 18 prior to pouring the concrete so that concrete cannot escape 90 through the drain outlets 66.

Next, the support plate 22 is threaded to the second end 74 of the core 18. The support plate 22 can be threaded deeper or shallower to adjust the overall height of the pedestal 10. The lockdown assembly 30 is coupled to the support plate 22 by placing the bottom pad 190 on the support plate 22 so that the hub 162 of the support plate 22 is inserted into the orifice 194 of the bottom pad 190. The bottom pad 190 can be rotated relative to the support plate 22 until a desired angle is achieved. At this point, pavers can be positioned on the pedestal 10. In some applications, a paver is placed on the pedestal 10 so that one corner of the paver is resting on the bottom pad 190. If projections 210 are utilized, the paver can be pressed against two of the divider projections 218. The paver can also be aligned so that the raised projection(s) 114 are inserted into the recess(es) of the paver. If necessary, the bottom pad 190 can be rotated to re-adjust the angle of the paver. If the pedestal 10 is being utilized to support multiple pavers, the additional pavers can be assembled on the pedestal 10 in the same manner as just described. Once all of the pavers are in position, the top pad 186 can be placed on the paver. The top pad 186 and bottom pad 190 can act to clamp the pavers in place. Finally, the bolt 182 is used to secure the top pad 186, the bottom pad 190, and the support plate 22 together. The bolt 182 can pass through the aperture of the top pad 186 and can be threaded into the bore 162 of the support plate 22.

The order of assembly described above can be altered. For example, the support plate 18 and the locking assembly 30 can be attached to the core 18. Also, it will be appreciated that the anchoring assembly 26 can be used with pedestals having no lockdown assembly 30, or with a paver retaining and/or supporting assembly having a different structure and function than that described herein.

Various features and advantages of the invention are set forth in the following claims.

The invention claimed is:

1. A pedestal for supporting pavers on a surface, the pedestal comprising:
- a cylindrical core defining an axis;
- a base coupled to the cylindrical core and positioned to support the cylindrical core on the surface;
- a support plate coupled to the cylindrical core and adapted to support at least one paver; and
- an anchoring assembly including
  - a collar positioned axially between the base and the support plate;
  - an arm extending radially outward from the collar, the arm having a distal end and an attachment point at the distal end by which the arm is secured to the surface, wherein the attachment point is spaced apart from the cylindrical core and is proximate the surface; and
- a support ring positioned axially between the base and the collar to support the collar along the cylindrical core, wherein the collar is rotatable about the axis relative to the support ring.

2. The pedestal of claim 1, wherein the arm is pivotably coupled to the collar.

3. The pedestal of claim 1, wherein the arm is adapted to be mounted to the surface by a foot pivotably coupled to the arm.

4. The pedestal of claim 1, wherein the arm is one of a plurality of arms each extending radially outward from the collar.

5. The pedestal of claim 4, wherein the collar includes a plurality of arcuate portions coupled between the plurality of arms.

6. The pedestal of claim 1, wherein the anchoring assembly is movable to different positions along the cylindrical core between the base and the support plate.

7. The pedestal of claim 1, further including a top pad and a bottom pad, wherein the paver is received between the top pad and the bottom pad.

8. The pedestal of claim 7, wherein as least one of a group consisting of the top pad and the bottom pad is rotatable relative to the cylindrical core.

9. The pedestal of claim 7, wherein at least one of a group consisting of the top pad and the bottom pad includes at least one of a group consisting of a protrusion and a recess adapted to align the paver.

10. The pedestal of claim 1, wherein the base includes a convex surface in contact with the cylindrical core that enables the cylindrical core to swivel with respect to the base.

11. A pedestal for supporting pavers on a surface, the pedestal comprising:

a cylindrical core having a first end and a second end, the cylindrical core defining an axis extending between the first end and the second end;

a base coupled to the cylindrical core proximate the first end, the base positioned to support the cylindrical core;

a support plate coupled to the cylindrical core proximate the second end, the support plate adapted to support at least one paver tile;

a mounting member extending to and between a first location proximate the cylindrical core and a second location on the surface distal from the cylindrical core and the base, wherein the mounting member has an attachment point at the second location by which the mounting member is secured to the surface, wherein the attachment point is proximate the surface; and a support ring surrounding the cylindrical core and positioned axially between the base and the first location, wherein the support ring is rotatable about the axis relative to the mounting member, and wherein rotation of the support ring moves the mounting member axially along the axis of the cylindrical core without rotating the mounting member about the axis.

12. The pedestal of claim 11, wherein the mounting member is coupled to a collar surrounding the cylindrical core.

13. The pedestal of claim 12, wherein the support ring is positioned between the base and the collar.

14. The pedestal of claim 12, wherein the mounting member is pivotably coupled to the collar.

15. The pedestal of claim 11, wherein the mounting member is coupled to the support plate.

16. The pedestal of claim 11, wherein the mounting member is movable along the axis of the cylindrical core relative to the first end and the second end and wherein the mounting member is rotatable about the axis of the cylindrical core while maintaining a fixed axial position between the first end and the second end.

17. The pedestal of claim 11, wherein the mounting member includes an arm and a foot pivotably coupled to the arm.

18. The pedestal of claim 11, further including a second mounting member adapted to mount the pedestal to the surface at a third location on the surface distal from the cylindrical core, the second location, and the base.

* * * * *